US005778716A

United States Patent [19]

Moser

[11] Patent Number: 5,778,716

[45] Date of Patent: Jul. 14, 1998

[54] COILER FURNACE FOR A HOT STRIP

[75] Inventor: Friedrich Moser, St. Florian, Austria

[73] Assignee: Voest-Alpine Industrieanlagenbau GmbH, Linz, Austria

[21] Appl. No.: 737,829

[22] PCT Filed: Apr. 11, 1996

[86] PCT No.: PCT/AT96/00070

§ 371 Date: Nov. 20, 1996

§ 102(e) Date: Nov. 20, 1996

[87] PCT Pub. No.: WO96/32509

PCT Pub. Date: Oct. 17, 1996

[30] Foreign Application Priority Data

Apr. 13, 1995 [AT] Austria ..... A 647/95

[51] Int. Cl.[6] ..... B21B 27/06

[52] U.S. Cl. ..... 72/202; 72/200

[58] Field of Search ..... 72/200, 202, 229, 72/142, 146, 148; 242/562, 562.1, 564.4, 532.6, 532.7; 29/81.11

[56] References Cited

U.S. PATENT DOCUMENTS

| | | | |
|---|---|---|---|
| 5,009,092 | 4/1991 | Buchegger | 72/148 |
| 5,131,134 | 7/1992 | Quambusch et al. | 72/202 |
| 5,430,930 | 7/1995 | Passoni et al. | 72/202 |

OTHER PUBLICATIONS

MDS Mannesmann Demag Sack GmbH, Peter Meyer, "Thin Slab Caster Combined With a Steckel Mill", this paper was read by Mr. Peter Meyer at the 6th I.A.S.M.O. Annual Meeting, Outokumpu Oy Polarit, 10.–14. Sep. 1990, Tornio/Finland.

*Primary Examiner*—Lowell A. Larson
*Assistant Examiner*—Rodney Butler
*Attorney, Agent, or Firm*—Birch, Stewart, Kolasch & Birch, LLP

[57] ABSTRACT

A coiler furnace for a hot strip includes a strip inlet opening, at least one coiler formed by a coiler mandrel, a strip outlet opening different from the strip inlet opening and a heat-insulating furnace wall surrounding the coiler on all sides. A coiler mandrel is movable by an adjustment device into a coiling start position at the strip inlet opening for the purpose of seizing the beginning of the hot strip as well as into an uncoiling position in which a coil wound on the coiler mandrel is pressed against a pressing roller arranged, or to be arranged, stationarily at the coiler furnace. The pressing roller precedes the strip outlet opening in the uncoiling direction, for the purpose of the storage of as large an amount of energy as possible at a structural simplicity, wherein as few movable parts as possible are to be sufficient, in particular, in the hot zone of the coiler furnace and also reliable uncoiling without jamming of the strip in the furnace interior, in particular at the starting of uncoiling, is to be ensured in addition to the safe seizure of the beginning of the hot strip.

20 Claims, 3 Drawing Sheets

COILER FURNACE FOR A HOT STRIP

BACKGROUND OF THE INVENTION

1. Field of the Invention

The invention relates to a coiler furnace for a hot strip, comprising a strip inlet opening, at least one coiler means formed by a coiler mandrel, a strip outlet opening different from the strip inlet opening and a heat-insulating furnace wall surrounding the coiler means on all sides.

2. Description of the Background

A coiler furnace of this type is known, for instance, from EP-A- 0 619 377. There, the coiler mandrel is movably mounted within the coiler furnace, being movable from a starting position, in which the coiler pick-up of the coiler mandrel comes to lie at the strip inlet opening, in dependence on the coil diameter in a manner that the coil in any phase of coiling by its external side is pressed against two pressing rollers arranged at the strip inlet opening and mounted immovably relative to the coiler furnace. This coiler furnace in the first place serves to receive a hot strip through the strip inlet opening and to convey this hot strip out again through the strip inlet opening by reversibly driving the coiler mandrel. According to a special embodiment, the coiler furnace is provided with a second opening, through which the strip optionally may be conveyed out of the coiler furnace during uncoiling. However, it involves the drawback that the strip end may get open thus clinging to the coiler furnace, in particular in case of a thin and hot and hence soft hot strip.

A coiler furnace of the initially described kind, yet with two coiler mandrels provided in the furnace interior, is known from DE-B- 25 25 302. This known coiler furnace serves to attain extended residence times in the continuous passage of the strip through the coiler furnace in order to enable hot treatment of the metal strip. In doing so, a metal strip is coiled on a first coiler mandrel, from there is recoiled to a second coiler mandrel and is uncoiled from the second coiler mandrel. This known arrangement is expensive and complex in construction. It comprises a great number of movable parts in the interior of the furnace space thus making the coiler furnace prone to failures. Furthermore, only a very particular mode of operation, i.e., coiling, recoiling, uncoiling, can be adjusted, the strip to be coiled having to be coiled at the same speed as the strip to be uncoiled. The adjustment of an individual residence time for a strip within the coiler furnace and hence the observance of a time allowance due to particular circumstances are impossible.

The problem of providing differently long residence times of a coil within the coiler furnace arises, for instance, in the production of a strip by the continuous casting process including a rolling stand immediately following thereupon.

There, the problem arises that the casting speed is not sufficient for an optimum rolling procedure. The rolling speed during hot rolling, as a rule, is higher by a power of ten than the casting speed in a continuous caster. In order to avoid making a compromise that would reduce the quality of the strip, it is, therefore, common to provide strip coiling means between the caster and the consecutively arranged rolling stand, in particular if the latter is a reversing stand.

In that case, a coiler furnace for receiving the continuously cast strip is provided between the continuous caster and a consecutively arranged hot-strip rolling stand in order to allow the heat contained in the continuously cast strip to be utilized as completely as possible in consecutively provided hot-strip rolling.

From EP-B- 0 541 574, EP-A- 0 177 187 and EP-A- 0 321 733 it is each known to provide two strip coiler devices between the continuous caster and the consecutively arranged rolling stand, one coiler device being located above, and one coiler device being located below, the strip plane formed by the strand delivered from the continuous caster and having strip cross section. While one of the strip coiler devices is winding up the strand emerging from the continuous caster and optionally already subjected to prerolling, a strand section previously taken up from the continuous caster is uncoiled by means of the second coiler device and fed to a consecutively arranged hot-strip rolling means such that hot-strip rolling is decoupled from the continuous casting procedure in terms of movement and speed and hot-strip rolling may be realized at conventional optimum rolling speeds and completely independent of the continuous casting speed.

Thus, in the prior art described above two strip coiling devices of conventional design have been superimposed. Such a construction is described in more detail, for instance, in the document Mannesmann Technology, Peter Meyer, Thin Slab Caster Combined with a Steckel Mill" (a written reproduction of a speech held in September 1990). In the exemplary embodiment indicated there, two coiler mandrels are each separately surrounded by a heat-insulated housing. Guiding means for reversing the strip are pivotably arranged between the two housings so as to be able to feed the strand to one of the housings each. The housings themselves are rotatable about the axes of the coiler mandrels such that the strip entry opening of the housing, upon winding of a coil and separation of the coiled strand from the strand further emerging from the continuous caster, may be pivoted in the direction towards the rolling mill following upon the continuous caster and serve as a strip outlet opening.

This arrangement from a technological point of view is rather consuming because a relatively large mass is to be moved. Since the rotatable housing must be connectable to heating energy sources and actually is connected to such energy sources in one specific rotary position only and must be separated from these energy sources during rotation into another position, this also involves a drawback in terms of heat technology in addition to the thus caused complexness, for the continuous supply of energy no longer is ensured in every position.

Furthermore, the strip end always is outside of the furnace in the driving rollers arranged on the external side of the furnace.

SUMMARY OF THE INVENTION

The invention aims at avoiding these drawbacks and difficulties and has as its object to provide a coiler furnace for a hot strip, which enables the storage of as large an amount of energy as possible at a structural simplicity with as few movable parts as possible being sufficient, in particular, in the hot zone of the coiler furnace. Furthermore, reliable uncoiling without jamming of the strip in the furnace interior, in particular at the start of uncoiling, is to be ensured in addition to the safe seizure of the beginning of the hot strip.

In accordance with the invention this object is achieved in that the coiler mandrel is movable by means of an adjustment device into a coiling start position at the strip inlet opening for the purpose of seizing the beginning of the hot strip as well as into an uncoiling position in which a coil wound on the coiler mandrel is pressed against a pressing roller arranged, or to be arranged, stationarily at the coiler furnace, which pressing roller precedes the strip outlet opening in the uncoiling direction.

A preferred embodiment is characterized in that two coiler mandrels are provided in the furnace interior in an axis-parallel arrangement, which are both movable by an adjustment device into a coiling start position at the strip inlet opening for the purpose of seizing the beginning of the hot strip as well as into an uncoiling position in which a coil wound on the coiler mandrel is pressed against a pressing roller arranged, or to be arranged, stationarily at the coiler furnace, which pressing roller each precedes the strip outlet opening in the uncoiling direction. Thereby it is possible to provide for individual coiling and uncoiling of a hot strip and individual intermediate attendance times and to improve the thermal economy inasmuch as an exchange of part of the heat contents of the strips is feasible between the two hot strips present in the coiler furnace with guiding means in the interior of the coiler furnace being largely renounceable despite the double arrangement of the coiler mandrels. This ensures the trouble-free operation of the coiler furnace even at high temperatures. Moreover, the coiler furnace allows for a particularly closely adjacent arrangement of the coiler mandrels, thus being able to dimension the furnace interior of the coiler furnace to be very small and to provide for an optimum heat exchange or heat transfer between the hot strips to be coiled and uncoiled.

Preferably, a single strip inlet opening is flanked by a pair of driving rollers, the pair of driving rollers flanking the strip inlet opening suitably being formed integral with the furnace wall and the roller gap formed by the pair of driving rollers constituting the strip inlet opening. Thus, it is possible to seize the hot strip to be coiled in time, i.e., to minimize uncontrolled heat radiation from the hot strip before entering the coiler furnace; the coiler furnace may be arranged immediately after a preceding aggregate. The pair of driving rollers has an elevated temperature such that it affects the temperature of the hot strip only slightly—if at all.

To adjust a sufficient strip tension, one of the driving rollers of the pair of driving rollers suitably is adjustable relative to the second driving roller from a position clamping the hot strip into a position allowing the hot strip to pass freely and vice versa.

A particularly small furnace interior is feasible in that the furnace wall includes two strip outlet openings on the side of the coiler furnace opposite the strip inlet opening, one strip outlet opening each being associated with one of the coiler mandrels.

Advantageously, each of the strip outlet openings is flanked by a pressing roller.

To safeguard the perfect delivery of the hot strip, one coil opener advantageously is provided at each of the strip outlet openings, which coil opener suitably is movable from a waiting position so as to be adjustable relative to the coil, and back.

In order to be able to do with a single pair of driving rollers for both of the strip outlet openings, a hot strip guide advantageously leads from each of the strip outlet openings to a single pair of driving rollers, the guides suitably being provided with heating means, preferably inductive heating means, to avoid cooling of the strip end emerging at the start of the uncoiling procedure.

A preferred embodiment is characterized in that the two roller gaps formed by the pairs of driving rollers with their central axes are arranged approximately in a symmetrical center plane of the coiler furnace.

According to another preferred embodiment, the coiler furnace has a single strip outlet opening at which a pair of driving rollers is arranged, a coil opener and hot strip guides leading to the strip outlet opening being arranged in the furnace interior of the coiler furnace. Advantageously, the pair of driving rollers flanking the hot-strip outlet opening are formed integral with the furnace wall. In this embodiment, a single coil opener may do. The latter then is movable to the respective coiler mandrel, e.g., by pivoting.

A particularly space-saving construction, i.e., a construction having a particularly small furnace interior, is characterized in that the coiler mandrels are each displaceable in a displacement plane located oblique to the plane formed by the roller gaps of the pairs of driving rollers, the displacement plane of each coiler mandrel advantageously enclosing an angle of 30° to 60°, preferably about 45°, with the plane connecting the roller gaps with the angle apex being oriented in a direction towards the strip inlet opening.

In order to ensure the coil to be perfectly pressed at the pressing rollers during coiling and also during uncoiling, the axes of the pressing rollers advantageously each lie in the displacement planes in which the axes of the coiler mandrels are movable or in a region deviating therefrom by an angular range of ±20° —measured from the axis of the coiler mandrel.

Advantageously, the coiler furnace according to the invention is used with a plant for the production of a hot strip comprising a continuous caster for casting a hot strip, a hot-strip separation means, a coiler device and a hot-strip rolling means, wherein the roller gaps formed by the pairs of driving rollers suitably are each located in the strip guiding plane of the continuous caster.

Another advantageous application of a coiler furnace according to the invention is the arrangement of the same between a roughing stand and a finishing train in a rolling mill, wherein the coiler furnace serves as a buffer between the roughing stand and the finishing train and may be equipped with a single coiler mandrel only.

With the last-mentioned application of the coiler furnace according to the invention, the length of a rolling mill arrangement comprised of a roughing stand and a finishing train may be shortened considerably, because the preliminary strip rolled from a slab, by means of the coiler furnace according to the invention, may readily be immediately stored in the coiled state between the roughing stand and the finishing train such that the roughing stand and the finishing train can be approached more closely to each other. Moreover, the coiler furnace in this case serves as a buffer in case a rolling procedure has not been completed in the finishing train, yet the preliminary strip has already emerged from the roughing stand.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

By 1 the housing of a coiler furnace is denoted, whose furnace wall 2 is designed to be heat-insulated, surrounding two coiler mandrels 4 arranged in the furnace interior 3 as closely as possible.

Figure 1:
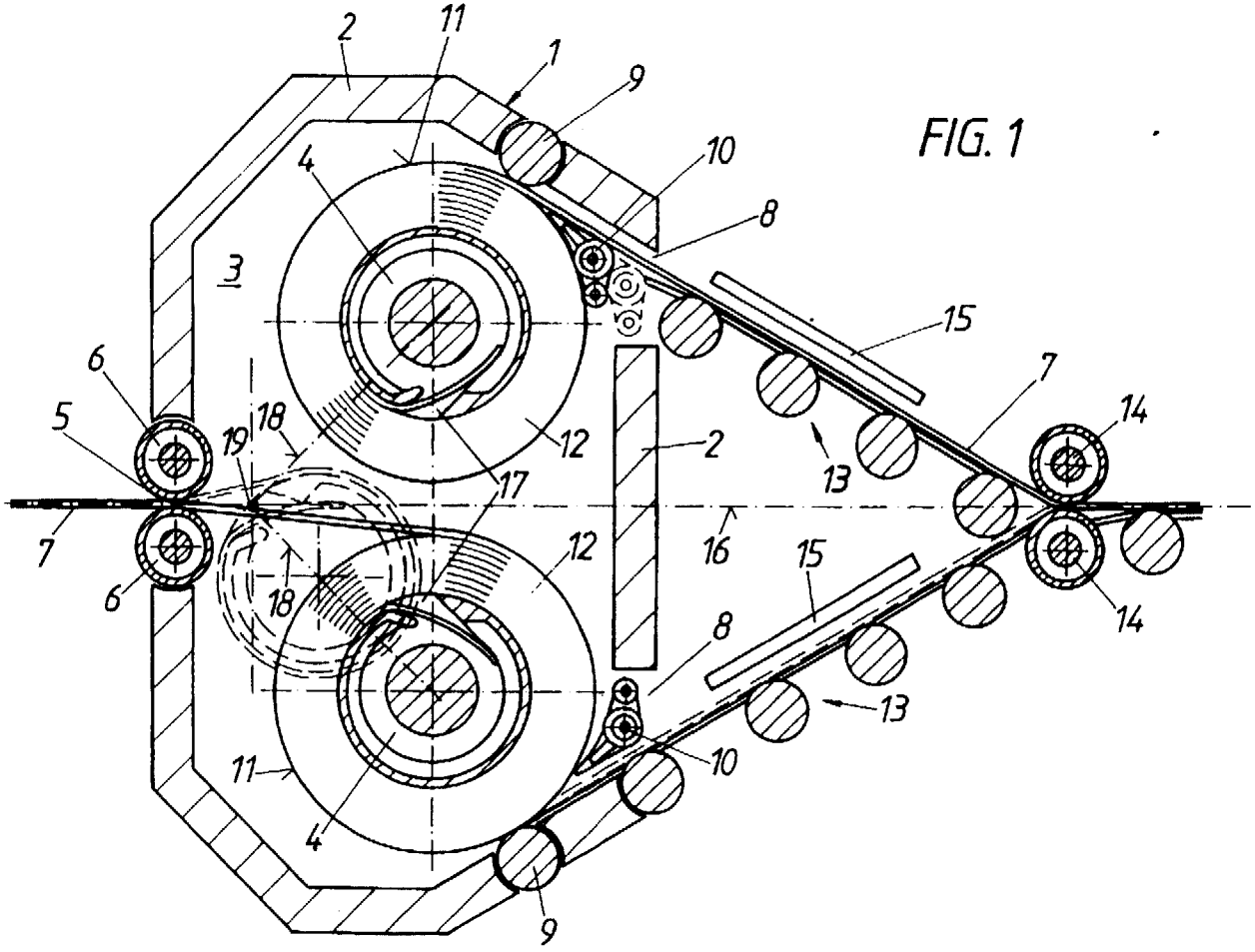
FIGS. 1 and 2 are section views through a coiler furnace.

The furnace housing 1 has a strip inlet opening 5 formed by the roller gap of a pair of driving rollers 6. The pair of driving rollers 6 in the embodiment represented in FIG. 1 is formed integral with the furnace wall 2 so as to save space. One of the driving rollers 6 is adjustable relative to the opposite one while clamping a hot strip 7 running into the coiler furnace and is movable away from the opposite driving roller 6 under release of the hot strip 7.

The furnace housing 1 has two strip outlet openings 8, one of the strip outlet openings 8 each being associated with one of the coiler mandrels 4. In the vicinity of each of the strip outlet openings 8, a pressing roller 9 is arranged, which pressing rollers 9 are rotatable, yet are stationarily mounted with respect to the furnace housing 1. However, it would also be conceivable to resiliently support the pressing rollers 9 relative to the furnace housing 1 or to arrange them in a movable manner, for instance in order to withdraw a pressing roller 9 from the furnace interior 3 for a period of time in which it is out of function, and to arrange them in a heat-protected manner.

Furthermore, a coil opener 10, for instance, a coil opening sword, is provided at each of the outlet openings 8, either rigidly arranged relative to the furnace housing 1 or displaceable by a slight extent in the strip coiling direction and opposite thereto by means of an adjustment device not illustrated in detail such that the coil opener 10 is adjustable relative to the coil surface 11 of the coil 12 wound on one of the coiler mandrels 4 by its front end, i.e., its end directed towards the furnace interior 3.

From each of the strip outlet openings 8, a guide 13 (in the exemplary embodiment illustrated in FIG. 1 a rollerway with intermediate supports) reaches to a further pair of driving rollers 14, one of which rollers 14 again is pressable at the hot strip 7 to be uncoiled or is liftable from the same by a slight measure thereby releasing the hot strip 7. The guides are provided with inductive heating means 15, in particular, to prevent the strip end emerging from the strip outlet openings 8 to be cooled.

The arrangement of the pairs of driving rollers 6, 14, of the outlet openings 8 and of the guides 13 as well as also of the coiler mandrels 4 is chosen such that they are each located approximately symmetrical with respect to a center plane 16 laid through the coiler furnace and laid through the central axes of the roller gaps formed by the pairs of driving rollers 6 and 14.

What is essential to the coiler furnace according to the invention is the adjustability, i.e., the displaceability, of the coiler mandrels 4, each of the coiler mandrels 4 being movable in the direction towards the strip inlet opening 5 for the purpose of seizing the beginning of the hot strip to be coiled by means of a strip pick-up 17 provided on the coiler mandrel 4. The coiler mandrels 4 are movable from a position illustrated in FIG. 1 by broken lines for the lower coiler mandrel 4 into a position in which the hot strip 7 already wound on the coiler mandrel 4 is guided between the pressing roller 9 associated with this coiler mandrel 4 and the coiler mandrel 4, i.e., the coiler mandrel 4 is pressable at the pressing roller 9 by a predetermined force, which means that the coil would spring open after the strip end has passed; this is prevented by the mandrel 4 being pressed at the roller 9.

Thus, at first the beginning of the hot strip is seized by the coiler mandrel 4. After a determined number of revolutions the hot strip 7 is fixed to the coiler mandrel 4 by frictional engagement. After this, the coiler mandrel 4 is moved towards the pressing roller 9 until the coil surface 11 is pressed against the pressing roller 9. Until that point of time, a strip tension is maintained by clamping by means of the pair of driving rollers 6 at the strip inlet opening 5. Such clamping may then be released.

After the coiling procedure has been completed, the wound coil 12 is continued to be rotated in order to avoid one-side heating of the coil 12 or of the pressing roller 9 with the strip end always being held safely at the coil 12 thus preventing loosening of the coil 12.

The planes 18 in which the coiler mandrels are displaceable enclose an angle of about 45°, preferably an angle of between 30° and 60°, with the center or symmetrical plane 16, the angle apex 19 being oriented towards the strip inlet opening 5. In this manner, it is feasible to utilize the space provided within the furnace housing 1 to the optimum extent. Heating of the furnace interior 3 is not illustrated in detail. It is not necessarily required, namely if the hot strip 7 comes in at a temperature sufficient for hot rolling following upon uncoiling of the hot strip 7.

Figure 2:
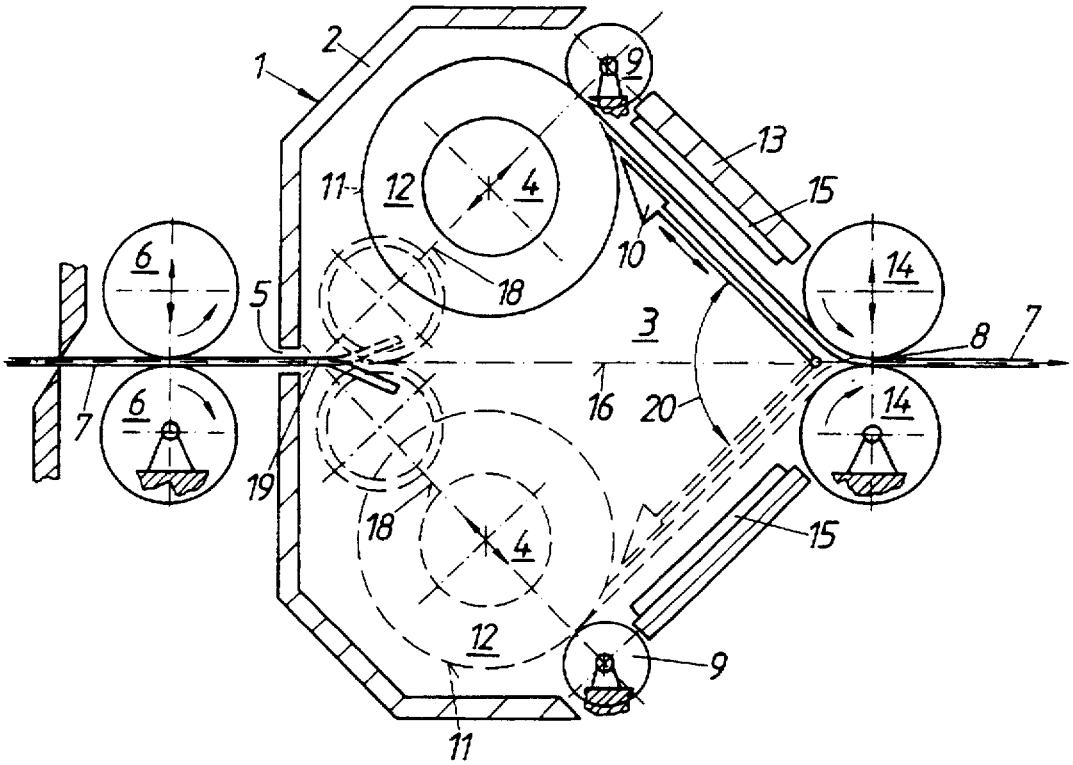

According to the embodiment illustrated in FIG. 2, the guides 13 and the coil openers 10 are arranged in the interior of the furnace housing 1. There, the pair of driving rollers 14 arranged at the single strip outlet opening 8 constitutes part of the furnace wall 2, i.e., this pair of driving rollers 14 is formed integral with the furnace wall 2, whereas the pair of driving rollers 6 provided at the strip inlet opening is arranged outside of the furnace interior 3 so as to precede the coiler furnace. There, only one coil opener 10 is provided, which is adjustable relative to the respective coil 12 by pivoting in the direction of the double arrow 20.

It is essential to the coiler furnace according to the invention that the geometric conditions during uncoiling are independent of the coil diameter thus remaining constantly equal such that the coil opener 10 need not carry out any movement except for offering a possible displaceability in the direction of the guides 13.

Actuation units 30 not illustrated in detail and engaging at bearing blocks of the coiler mandrels 4, for instance, adjustment cylinders, etc. serve to adjust the coiler mandrels 4 and, like the bearing blocks, preferably are arranged outside of the furnace interior 3. The actuation units 30 may be controllable separately so as to counteract any lateral strip course by adjusting the inclination of the coiler mandrels as is described, for instance, in EP-A- 0 619 377.

Figure 3:
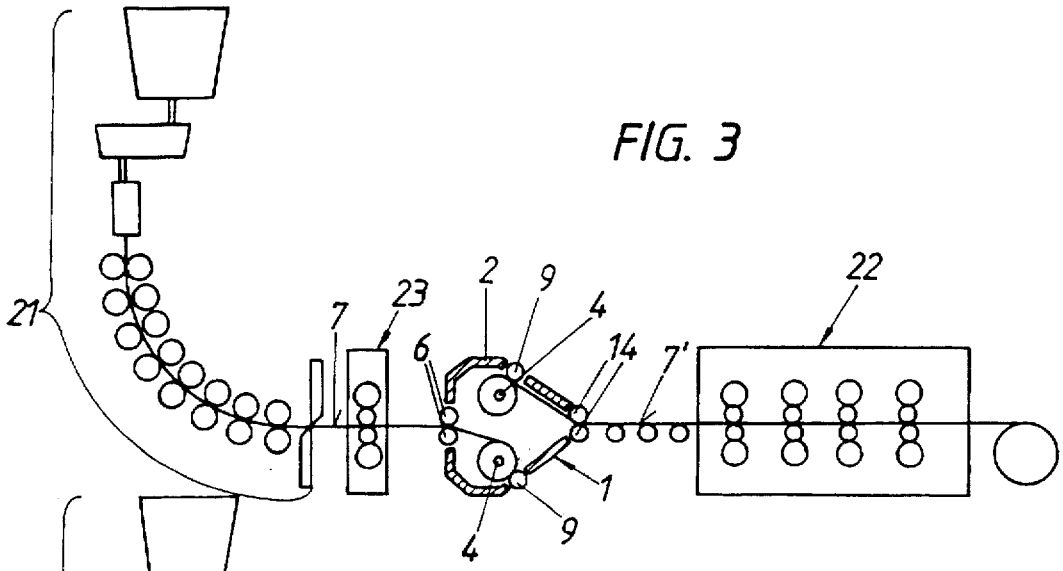
FIGS. 3 to 6 depict advantageous applications of the coiler furnace according to the invention.

FIG. 3 illustrates the application of the coiler furnace according to the invention in the production of a hot strip between a continuous caster 21 and a consecutively arranged rolling train including a rolling stand 22 with the hot strip 7 produced in the continuous caster 21 at first being subjected to pre-deformation by means of a roughing stand 23 directly out of the continuous casting heat in an on-line process and subsequently being coiled in the coiler furnace. A hot strip 7' previously coiled in the coiler furnace during the on-line coiling of the continuously cast hot strip 7 is rolled to the desired strip thickness in a rolling stand 22 and subsequently is coiled again.

Figure 4:
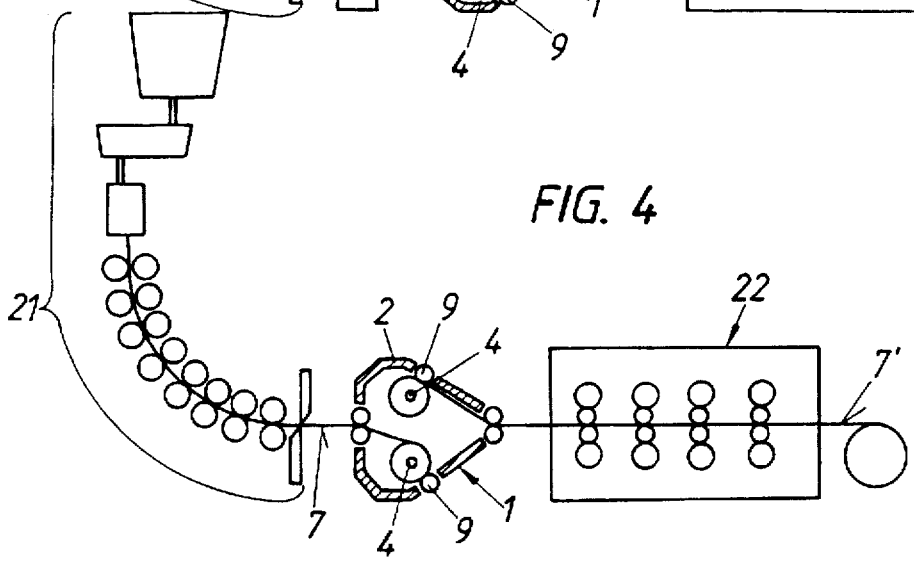

FIG. 4 depicts a similar plant, yet without a roughing stand.

Figure 5:
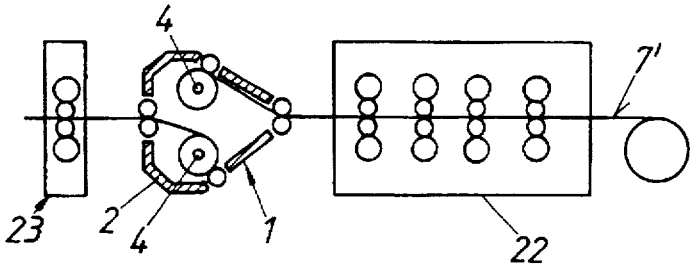

According to FIG. 5, the coiler furnace according to the invention is arranged in a rolling train between a roughing stand 23 and a finishing stand 22.

Figure 6:
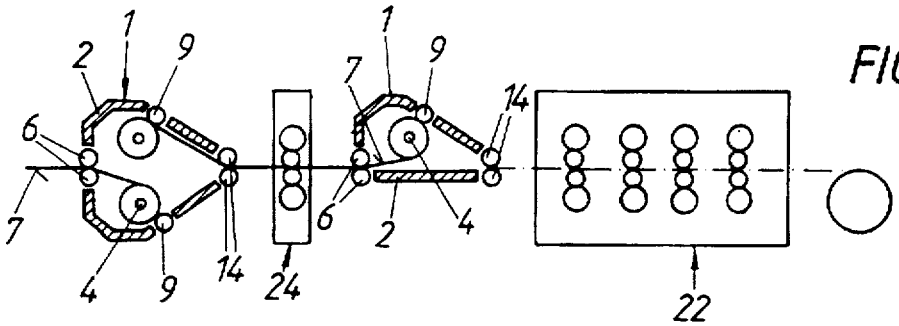

According to the embodiment represented in FIG. 6, a coiler furnace according to the invention, yet equipped with a single coiler mandrel 4 is employed in combination with a coiler furnace according to the invention comprising two coiler mandrels 4. The coiler mandrel 4 of the coiler furnace comprising but one coiler mandrel 4 likewise is movable by an adjustment device into a coiling start position at the strip inlet opening as well as into an uncoiling position in which the coil already wound on the coiler mandrel 4 is pressed against a pressing roller 9 stationarily arranged at the coiler furnace. A reversing stand 24 is provided between the two coiler furnaces according to the invention; a rolling train 22, e.g., a finishing train, follows. During the reversing operation, the subsequent hot strip 7 arriving, for instance, from a continuous caster may already be coiled in the coiler furnace equipped with two coiler mandrels 4.

The strip tension during the coiling procedure is controlled in the following manner: The hot strip 7' immediately after the reversing stand 24 enters the respective coiler furnace. After the beginning of the strip has been seized by the pair of driving rollers 6 and 14, respectively, the functions of the latter are as follows:

Conducting the beginning of the strip into the strip pick-up 17 of the coiler mandrel 4.

Building up a strip tension between the pair of driving rollers 6 and 14, respectively, and the reversing stand 24 until frictional engagement at the coiler mandrel 4 has been reached. As soon as such frictional engagement has been effected, the strip tension is caused by controlling the moments of the coil mandrel 4 between the coil mandrel 4 and the reversing stand 24.

After the hot strip 7' has left the reversing stand 24, the strip tension is ensured between the pair of driving rollers 6 and 14, respectively, and the coiler mandrel 4.

During reversal of the hot strip 7', the hot strip 7 is not completely drawn into the coiler furnaces.

After the final pass the hot strip 7 is completely drawn into the coiler furnace where it remains in the storage position until the consecutively arranged rolling train 22 is ready for reception.

The invention being thus described, it will be obvious that the same be varied in many ways. Such variations are not to be regarded as a departure from the spirit and scope of the invention, and all such modifications as would be obvious to one skilled in the art the art were intended to be included within the scope of the following claims.

What is claimed is:

1. A coiler furnace for a hot strip, comprising a strip inlet opening, at least one coiler means formed by a coiler mandrel, a strip outlet opening different from the strip inlet opening and a heat-insulating furnace wall surrounding the coiler mandrel on all sides, wherein the coiler mandrel is movable by an adjustment device into a coiling start position at the strip inlet opening for the purpose of seizing the beginning of the hot strip, as well as into an uncoiling position in which a coil wound on the coiler mandrel is pressed against a pressing roller arranged, or to be arranged, stationarily at the coiler furnace, which pressing roller precedes the strip outlet opening in the uncoiling direction.

2. The coiler furnace according to claim 1, wherein two coiler mandrels are provided in the furnace interior in an axis-parallel arrangement, which are both movable by adjustment devices into a coiling start position at the strip inlet opening for the purpose of seizing the beginning of the hot strip, as well as into an uncoiling position in which a coil wound on the coiler mandrel is pressed against a pressing roller arranged, or to be arranged, stationarily at the coiler furnace, which pressing roller each precedes the strip outlet opening in the uncoiling direction.

3. The coiler furnace according to claim 1 or 2, wherein a single strip inlet opening is flanked by a pair of driving rollers.

4. The coiler furnace according to claim 1, wherein the coiler furnace has a single strip outlet opening at which a pair of driving rollers are arranged, a coil opener and hot strip guides leading to the strip outlet opening being arranged in the furnace interior of the coiler furnace.

5. A rolling mill arrangement comprising a reversing stand and a finishing train, and including a coiler furnace according to claim 1.

6. The coiler furnace according to claim 2, wherein the furnace wall includes two strip outlet openings on the side of the coiler furnace opposite the strip inlet opening, one strip outlet opening each being associated with one of the coiler mandrels.

7. An arrangement for the production of a hot strip comprising a continuous caster for casting a hot strip, a hot-strip separation means, a coiler device and a hot-strip rolling means, and including the provision of a coiler furnace according to claim 2.

8. The coiler furnace according to claim 6, wherein each of the strip outlet openings is flanked by a pressing roller.

9. The coiler furnace according to claim 6 or 8, wherein a coil opener is provided at each of the strip outlet openings.

10. The coiler furnace according to claim 6, wherein a hot strip guide leads from each of the strip outlet openings to a single pair of driving rollers.

11. The coiler furnace according to claim 9, wherein the coil opener is movable from a waiting position so as to be adjustable relative to the coil, and back.

12. The coiler furnace according to claim 10, wherein the guides are provided with heating means.

13. The arrangement according to claim 7, wherein roller gaps formed by pairs of driving rollers are each located in the strip guiding plane of the continuous caster.

14. The coiler furnace according to claim 3, wherein the pair of driving rollers flanking the strip inlet opening are formed integral with the furnace wall and a roller gap formed by the pair of driving rollers constitutes the strip inlet opening.

15. The coiler furnace according to claim 3, wherein one of the driving rollers of the pair of driving rollers is adjustable relative to the second driving roller from a position clamping the hot strip into a position allowing the hot strip to pass freely and vice versa.

16. The coiler furnace according to claim 3, wherein coiler mandrels are each displaceable in a displacement plane located oblique to the plane formed by roller gaps of the pairs of driving rollers.

17. The coiler furnace according to claim 12, wherein two roller gaps formed by the pairs of driving rollers with their central axes are arranged approximately in a symmetrical center plane of the coiler furnace.

18. The coiler furnace according to claim 16, wherein the displacement plane of each coiler mandrel encloses an angle of 30° to 60° with the plane connecting the roller gaps, with the angle apex being oriented in a direction towards the strip inlet opening.

19. The coiler furnace according to claim 16 or 18, wherein the axes of the pressing rollers each lie in the displacement planes in which the axes of the coiler mandrels are movable or in a region deviating therefrom by an angular range of ±20° measured from the axis of the coiler mandrel.

20. The coiler furnace according to claim 4, wherein the pair of driving rollers flanking the hot-strip outlet opening are formed integral with the furnace wall.

* * * * *